US006034584A

United States Patent [19]

Hilfiker

[11] Patent Number: 6,034,584

[45] Date of Patent: Mar. 7, 2000

[54] ARRANGEMENT FOR MECHANICALLY COUPLING AN OVERLOAD RELAY TO A CONTACTOR

[75] Inventor: Peter Hilfiker, Buchs, Switzerland

[73] Assignee: Allen-Bradley Company, LLC, Milwaukee, Wis.

[21] Appl. No.: 09/003,992

[22] Filed: Jan. 7, 1998

[30] Foreign Application Priority Data

Aug. 6, 1997 [CH] Switzerland ..... 1862/97

[51] Int. Cl.[7] ..... H01H 9/00; H01H 67/02; H01H 51/08

[52] U.S. Cl. ..... 335/132; 335/202

[58] Field of Search ..... 335/6, 11, 132, 335/202; 200/293, 303, 307

[56] References Cited

U.S. PATENT DOCUMENTS 4,926,149 5/1990 Saens et al. ..... 335/132

*Primary Examiner*—Michael L. Gellner
*Assistant Examiner*—Raymond Barrera
*Attorney, Agent, or Firm*—David G. Luettgen; John J. Horn; William R. Walbrun

[57] ABSTRACT

The arrangement for mechanically coupling an overload relay (1) to a contactor (2, 15) is suitable for use with a contactor (2) having connection terminals (11) with wire cages (17) as well as with a contactor (15) having connection terminals (16) with pressure plate claws (12). In order to allow mechanical coupling for both types of connection terminals (11, 16), the coupling cutout in the base of the contactor (2, 15) contains a central cutout (7) and two slots (8, 9) on both sides of the central cutout (7), which are aligned in the pick-up direction of the connection terminals (11, 16). The central cutout (7) is provided to accept the entire end section of the hook (3), and both the slots (8, 9) accept only the flat end section (4) that lies behind the latch element (5) of the hook (3). Depending on the type of connection terminal of the contactor (2, 15), the latch element (5) locks behind the rim defined by either the lower slot (9) or the upper slot (8), because the overload relay (1) and therefore the latch element (5) is pushed down when connecting to terminals (11) with pressure plate claws (12), and is pulled up when connecting to terminals (16) with wire cages (17).

14 Claims, 2 Drawing Sheets

ARRANGEMENT FOR MECHANICALLY COUPLING AN OVERLOAD RELAY TO A CONTACTOR

BACKGROUND OF THE INVENTION

1. Field of the Invention

The present invention relates to an arrangement for mechanically coupling an overload relay to a contactor. More specifically, the present invention relates to an arrangement wherein the overload relay comprises at least one protruding hook which is inserted into a coupling cutout located at a contactor housing and which has a latch element molded onto at least one of two sides facing away from each other on a flat end section of the hook, and wherein the overload relay supports at least one protruding electrically conductive connection pin which is inserted into a connection terminal of the contactor and is retained therein.

2. Description of Related Art

EP-A1-0774768 describes an arrangement for mechanically and electrically coupling an overload relay to a contactor. In this arrangement, the overload relay is equipped with flexible, deformable hooks, whose latch elements latch into and behind rims of orifices in a housing of the contactor. Rigid, electrically conductive connection pins of the overload relay are inserted into the connection terminals of the contactor and are clamped into place therein.

As a result, in this arrangement, the bending moment that occurs during operation must be absorbed by the connection terminals alone. The flexible, deformable hooks do not relieve the connection terminals during a bending moment load. In this fashion, the mechanical and electrical connection between the overload relay and the contactor in this arrangement is secured.

In practice, a choice exists between connection terminals that have wire cages and connection terminals that have pressure plate claws. With the wire cages, the connection pin of the overload relay is pulled up to the connection piece of the contactor from below. In contrast, with pressure plate claws, the connection pin is pushed down to the connection piece of the contactor from the top. The two types of coupling therefore result in different relative heights between the overload relay and the contactor. For this reason, the flexible deformable hooks on the overload relay must be at different heights for the two types of connection terminals. This, however, makes it necessary to manufacture two different types of overload relays and to maintain an inventory of both types.

SUMMARY OF THE INVENTION

A primary object of the present invention is to provide an arrangement for mechanically coupling an overload relay to a contactor, wherein the arrangement is universally usable for contactor connection terminals with wire cages as well as for contactor connection terminals with pressure plate claws, and wherein the arrangement avoids the economic disadvantages of known arrangements.

According to one aspect of the invention, the present invention provides a contactor and an overload relay which is mechanically coupled to the contactor. The contactor includes a connection terminal and a housing. The housing has a coupling cutout formed therein which includes a central cutout, a first slot and a second slot. The first and second slots are disposed on opposite sides of the central cutout. The first slot extends from the central cutout in a direction generally away from the connection terminal, and the second slot extends from the central cutout in a direction generally toward the connection terminal.

The overload relay further includes a protruding rigid hook and a protruding connection pin. The hook has a flat end section and a latch element. The latch element is molded onto at least one of two sides that face away from each other on the flat end section of the hook. The flat end section and the latch element are inserted into the central cutout and are retained in one of the first and second slots. The connection pin, which is electrically conductive, is inserted into the connection terminal and is retained therein.

The overload relay is adapted for being mechanically coupled both to contactors comprising a pressure plate claw type of connection terminal and to contactors comprising a wire cage type of connection terminal. If the connection terminal is the pressure plate claw type, then the flat end section of the hook is disposed in the first slot and the latch element locks behind a first rim defined by a periphery of the first slot. If the connection terminal is the wire cage type, then the flat end section of the hook is disposed in the second slot and the latch element locks behind a second rim defined by a periphery of the second slot.

Advantageously, the arrangement can be used universally and provides one type of overload relay which can be connected both to contactors that have wire cage terminals and to contactors that have pressure plate claw terminals. The contactor housings remain unchanged, except for the design of the electrical terminals. The electrical terminals of the contactor can be freely selected, independent of the overload relay that has to be connected.

According to another aspect of the invention, the hook has a stop. The stop and the latch element are disposed on opposite sides of the coupling cutout, with the stop being disposed on the outside of the coupling cutout. The stop prevents over-insertion of the hook into the coupling cutout and secures the exact positioning of the overload relay with regard to the contactor.

According to yet another aspect of the invention, the present invention provides a method of mechanically coupling an overload relay to a contactor. The method comprises the steps of inserting a latch element of the overload relay into a coupling cutout of the contactor, inserting a connection pin of the overload relay into a connection terminal of the contactor, and tightening the connection terminal.

The connection terminal can be any one of a plurality of different possible types of connection terminals which are adapted for being mechanically coupled to the overload relay. When the connection terminal is tightened, the tightening causes the latch element to move within the coupling cutout the latch element. Advantageously, the latch element is movable in a plurality of different possible directions within the coupling cutout, depending on the type of the connection terminal which is used.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many modifications and changes within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DESCRIPTION OF THE PREFERRED EMBODIMENTS

Figure 1:
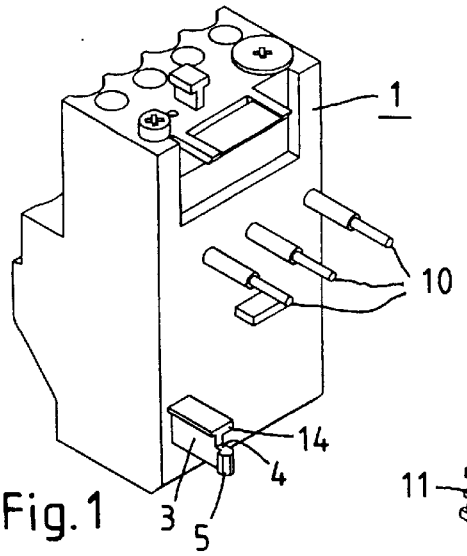
FIG. 1 is a perspective view of an overload relay according to an embodiment of the present invention.
Figure 2:
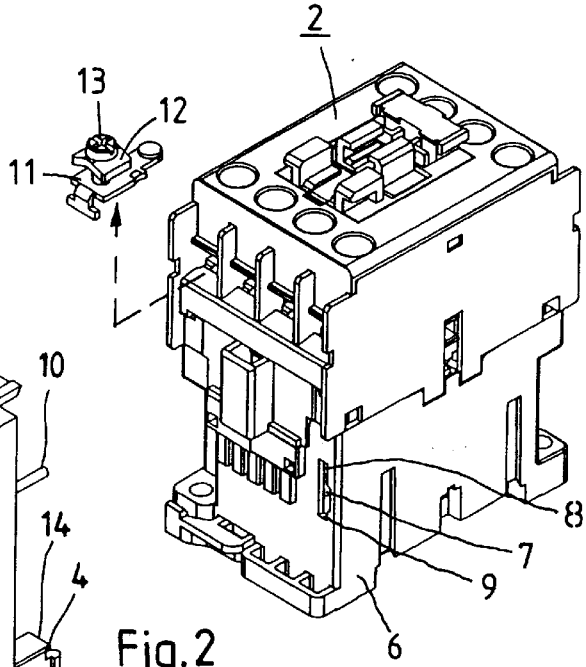
FIG. 2 is a perspective view of the overload relay illustrated in FIG. 1 and a contactor placed opposite thereof, the contactor having connection terminals that are equipped with pressure plate claws.

FIG. 1 is a perspective view of an overload relay 1 according to an embodiment of the invention. The overload relay 1 is provided for being mechanically coupled to a contactor 2 (FIG. 2). The overload relay 1 has a protruding hook 3 including a flat end section 4 and latch element 5. The latch element 5 is molded onto at least one of two sides facing away from each other on the flat end section 4 of the hook 3.

As illustrated in FIG. 2, a base 6 of the housing of the contactor 2 has coupling cutout including a central cutout 7 and two slots 8 and 9 which are disposed on both sides of the central cutout 7. The slots are aligned and extend in a direction towards the contactor 2 connection terminals and in the opposite direction. The central cutout 7 is provided for the insertion of the entire flat end section 4 of the hook 3 along with the latch element 5. The slots 8 and 9 are just wide enough so that only the flat end section 4 of the hook 3 fits into them.

The overload relay 1 is equipped with electrically conductive connection pins 10, which are provided for electrically and mechanically coupling the overload relay 1 to the contactor 2.

The contactor 2 is equipped with electrical connection terminals 11 with pressure plate claws 12. For better identification of the connection terminal 11 details, the active components of a connection terminal 11 with pressure plate claws 12 are illustrated separately from the contactor 2.

Figure 3:
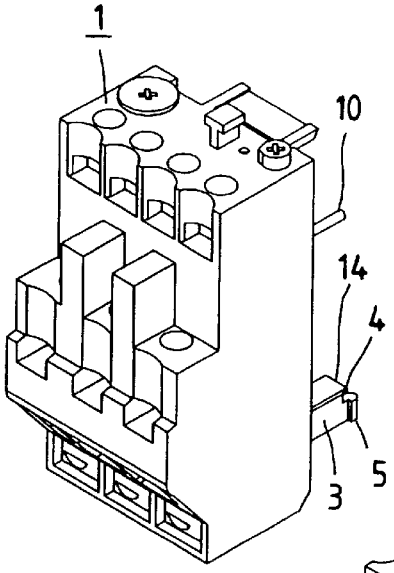
FIG. 3 is a perspective view of the overload relay illustrated in FIGS. 1 and 2 mechanically coupled to the contactor illustrated in FIG. 2.
Figure 3:
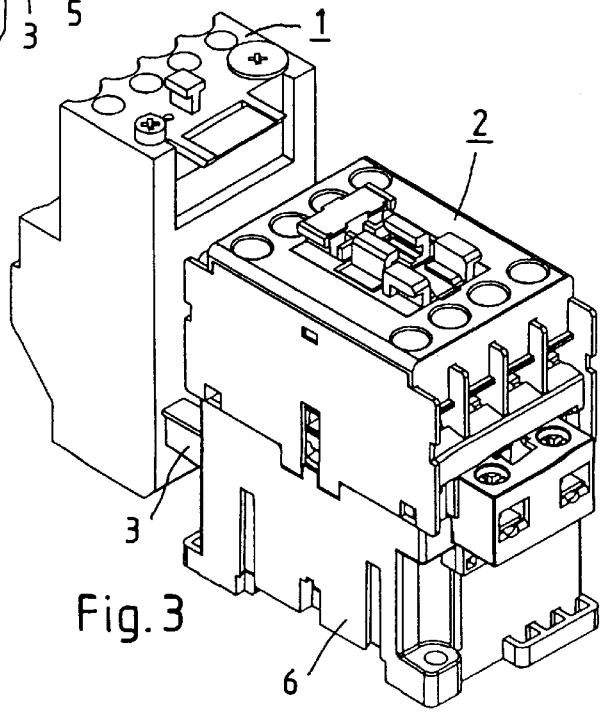

FIG. 3 is a perspective view of the overload relay 1 coupled to the contactor 2. The mechanical coupling of the overload relay 1 to contactor 2 is achieved by inserting the flat end section 4 of the hook 3 into the central cutout 7 of the coupling cutout and by inserting the connection pins 10 under the pressure plate claws 12. Thereafter, screws 13 of the connection terminals 11 are tightened. As the screws 13 are tightened, the connection pins 10 with the pressure plate claws 12 and thus, the entire overload relay 1, are pushed down into the pick-up direction of the connection terminals 11.

During this relative displacement between the overload relay 1 and the contactor 2, the flat end section 4 of the hook 3 is pushed into the slot 9 of the coupling cutout, which extends away from the connection terminals 11. The latch element 5 of the hook 3 thereby locks behind the rim of the slot 9. After tightening the screws 13 of the connection terminals 11 of the contactor 2, the connection pins 10 of the overload relay 1 are locked in the connection terminals 11. The latch element 5 of the hook 3 that is locked behind the rim of slot 9 secures the overload relay 1 to the contactor 2.

In order to prevent the hook 3 from being over-inserted into the coupling cutout, the hook 3 is provided with a stop 14, which engages the base 6 of the contactor 2 housing. The stop 14 lies immediately behind the flat end section 4 of the hook 3 that lies inside slot 9.

After loosening the screws 13 of the connection terminals 11, the overload relay 1 and the contactor 2 can again be detached.

Figure 4:
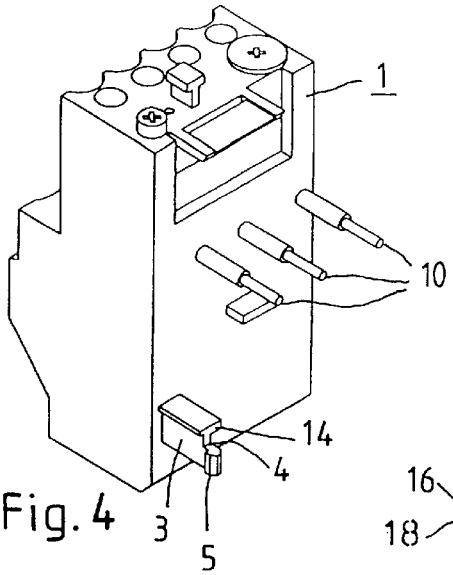
FIG. 4 is a perspective view of an overload relay according to an embodiment of the present invention.
Figure 5:
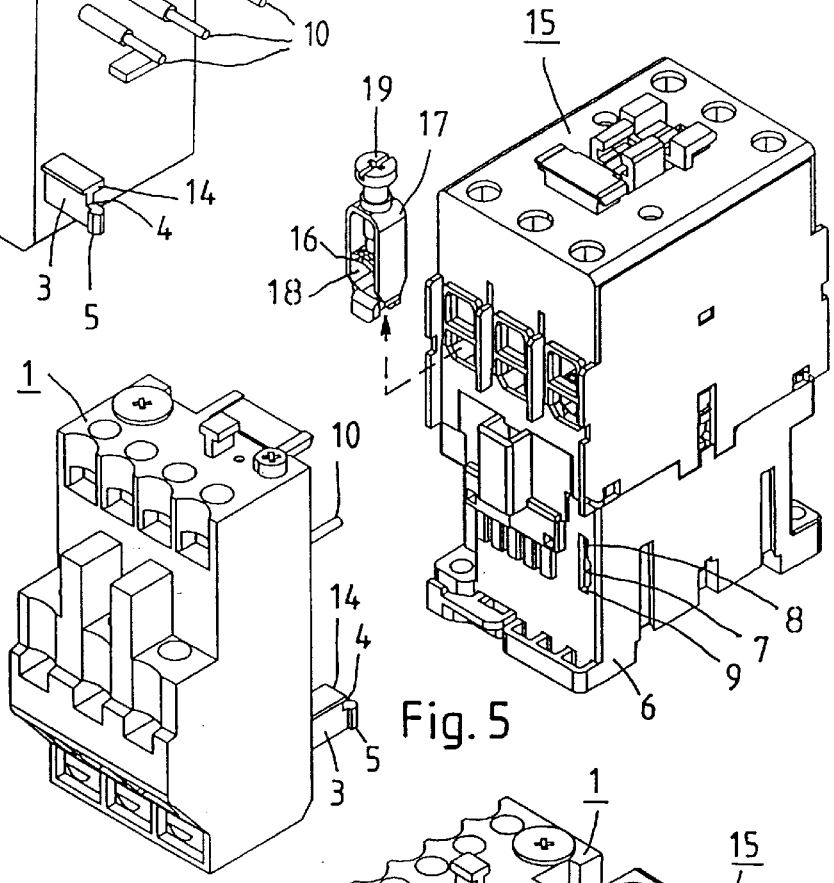
FIG. 5 is a perspective view of the overload relay illustrated in FIG. 4 and a contactor placed opposite thereof, the contactor having connection terminals that are equipped with wire cages.
Figure 6:
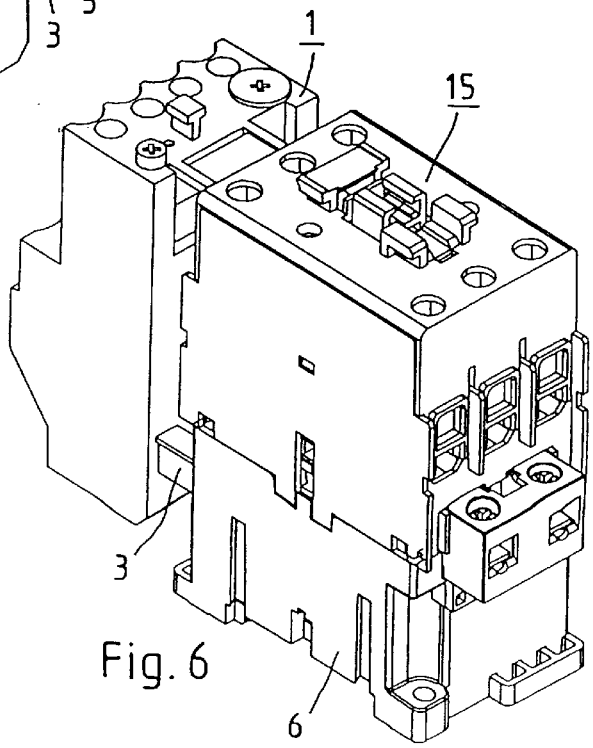
FIG. 6 is a perspective view of the overload relay illustrated in FIGS. 4 and 5 mechanically coupled to the contactor illustrated in FIG. 5.

The overload relay 1 shown in FIGS. 4–6 is identical to that shown in FIGS. 1–3 and has the same reference numbers. Likewise, the bases 6 of the contactors 2 and 15 are identical and have the same reference numbers. The only difference between the contactor 15 shown in FIGS. 4–6 and the contactor 2 in FIGS. 1–3 is in the connection terminals 16.

In FIG. 5, the connection terminal 16 of the contactor 15 is separately shown next to the contactor 15. The connection terminal 16 has a wire cage 17.

FIG. 6 is a perspective view of the overload relay 1 coupled to the contactor 15. During the mechanical coupling of the overload relay 1 to the contactor 15, the connection pins 10 of the overload relay 1 are inserted into the opening 18 of the wire cage 17. At the same time, the hook 3 is pushed into the central cutout 7 on the base 6 of the contactor 15, up to the stop 14. Thereafter, the screws 19 of the connection terminals 16 are tightened. As the screws 19 are tightened, the rigid connection pins 10, and thus the overload relay 1 that supports them, move toward the connection terminals 16. At that time, the flat end section 4 of the hook 3 is pushed into the slot 8 that is facing the connection terminals 16 in the base 6 of the contactor 15. After tightening the screws 19, the connection pins 10 are locked in the connection terminals 16, and the latch element 5 of the hook 3 locks behind the rim of slot 8, where it retains itself. The overload relay 1 is thus mechanically and electrically coupled to the contactor 15.

Again, this coupling can be detached by loosening the screws 19 of the connection terminals 16.

Many other changes and modifications may be made to the present invention without departing from the spirit thereof. The scope of these and other changes will become apparent from the appended claims.

We claim:

1. An apparatus comprising:

(A) a contactor, the contactor including (1) a connection terminal, and (2) a housing, the housing having a coupling cutout formed therein, the coupling cutout further including a central cutout, a first slot and a second slot, the first and second slots being disposed on opposite sides of the central cutout, the first slot extending from the central cutout in a direction generally away from the connection terminal and the second slot extending from the central cutout in a direction generally toward the connection terminal; and (B) an overload relay, the overload relay being mechanically coupled to the contactor, the overload relay further including (1) a protruding rigid hook, the hook having a flat end section and a latch element, the latch element being molded onto at least one of two sides that face away from each other on the flat end section of the hook, the flat end section and the latch element being inserted into the central cutout and being retained in one of the first and second slots, and (2) a protruding connection pin, the connection pin being electrically conductive, the connection pin being inserted into the connection terminal and being retained therein; and wherein the coupling cutout adapts the contactor to be mechanically coupled to the overload relay both if the contactor comprises a pressure plate claw type of connection terminal and if the contactor comprises a wire cage type of connection terminal, and if the connection terminal is the pressure plate claw type, then the flat end section of the hook is disposed in the first slot and the latch element locks behind a first rim defined by a periphery of the first slot, and if the connection terminal is the wire cage type, then the flat end section of the hook is disposed in the second slot and the latch element locks behind a second rim defined by a periphery of the second slot.

2. An apparatus according to claim 1, wherein the hook has a stop, the stop and the latch element being disposed on opposite sides of the coupling cutout with the stop being disposed on the outside of the coupling cutout, the stop preventing over-insertion of the hook into the coupling cutout.

3. An apparatus according to claim 1, wherein the connection terminal is the pressure plate claw type, and wherein the hook is inserted into the coupling cutout through the central cutout and is pulled into the first slot away from the connection terminal when the connection terminal is tightened.

4. An apparatus according to claim 1, wherein the connection terminal is the wire cage type, and wherein the hook is inserted into the coupling cutout through the central cutout and is pulled into the second slot toward the connection terminal when the connection terminal is tightened.

5. An apparatus according to claim 1, wherein the first and second slots are wider than the flat end section of the hook, the latch element is wider than the first and second slots, and the central cutout is wider than the latch element, such that the central cutout accepts the latch element and the flat end section of the hook, and the first and second slots accept only the flat end section of the hook.

6. An apparatus according to claim 1, wherein the overload relay further comprises first and second additional connector pins and wherein the contactor further comprises first and second additional connection terminals.

7. An apparatus comprising:

(A) a contactor, the contactor including (1) a connection terminal, and (2) a housing, the housing having a coupling cutout formed therein, the coupling cutout further including a central cutout, a first slot and a second slot; and (B) an overload relay, the overload relay being mechanically coupled to the contactor, the overload relay further including (1) a hook, the hook including a latch element which is inserted into the central cutout and is retained in one of the first and second slots, and (2) a connection pin, the connection pin being electrically conductive, the connection pin being inserted into the connection terminal and being retained therein.

8. An apparatus according to claim 7, wherein the hook has a stop, the stop and the latch element being disposed on opposite sides of the coupling cutout with the stop being disposed on the outside of the coupling cutout, the stop preventing over-insertion of the hook into the coupling cutout.

9. An apparatus according to claim 7, wherein the hook is rigid.

10. An apparatus according to claim 7, wherein the connection terminal is a pressure plate claw type connection terminal, and wherein a flat end section of the hook is disposed in the first slot and the latch element locks behind a first rim defined by a periphery of the first slot.

11. An apparatus according to claim 10 wherein, when the hook is inserted into the coupling cutout, the hook is inserted through the central cutout and is then pulled into the first slot away from the connection terminal when the connection terminal is tightened.

12. An apparatus according to claim 7, wherein the connection terminal is a wire cage type of connection terminal, and wherein the flat end section of the hook is disposed in the second slot and the latch element locks behind a second rim defined by a periphery of the second slot.

13. An apparatus according to claim 10 wherein, when the hook is inserted into the coupling cutout, the hook is inserted through the central cutout and then is pulled into the second slot toward the connection terminal when the connection terminal is tightened.

14. A method of mechanically coupling an overload relay to a contactor, the method comprising:

(A) inserting a latch element of the overload relay into a coupling cutout of the contactor;

(B) inserting a connection pin of the overload relay into a connection terminal of the contactor, the connection terminal being one of a plurality of different possible types of connection terminals which are adapted for being mechanically coupled to the overload relay; and (C) tightening the connection terminal, the tightening of the connection terminal causing the latch element to move within the coupling cutout;

wherein, when the connection terminal is tightened, the latch element is movable in a plurality of different possible directions within the coupling cutout depending on the type of the connection terminal, wherein the plurality of different possible types includes a pressure plate claw type of connection terminal and a wire cage type of connection terminal, and if the connection terminal is the pressure plate claw type, then the latch element moves in a first direction, and if the connection terminal is the wire cage type, then the latch element moves in a second direction opposite the first direction, wherein the coupling cutout is formed of a central cutout, a first slot and a second slot, wherein, when the latch element is inserted into the coupling cutout of the contactor, the latch element is inserted into the central cutout, wherein the first slot extends from the central cutout in the first direction, wherein the second slot extends from the central cutout in the second direction, and wherein, when the terminal is tightened, the latch element moves within the first slot if the connection terminal is the pressure plate claw type of connection terminal and moves within the second slot if the connection terminal is the wire cage type of connection terminal.

* * * * *